US007341819B2

(12) United States Patent
Goi et al.

(10) Patent No.: US 7,341,819 B2
(45) Date of Patent: Mar. 11, 2008

(54) METHOD OF MANUFACTURE OF PHOTOSENSITIVE MATERIAL PACKAGING BODY AND PHOTOSENSITIVE MATERIAL PACKAGING BODY

(75) Inventors: Katsunori Goi, Kanagawa (JP); Narito Goto, Sagamihara (JP); Tetsuo Shima, Akishima (JP); Hajime Kobayashi, Tokyo (JP); Nobuaki Tsuji, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 64 days.

(21) Appl. No.: 11/189,630

(22) Filed: Jul. 25, 2005

(65) Prior Publication Data

US 2006/0035168 A1 Feb. 16, 2006

(30) Foreign Application Priority Data

Aug. 12, 2004 (JP) ..... 2004-235077

(51) Int. Cl.
*G03C 1/00* (2006.01)

(52) U.S. Cl. ..... 430/270.1; 53/411

(58) Field of Classification Search ..... 430/270.1; 53/411

See application file for complete search history.

(56) References Cited

U.S. PATENT DOCUMENTS 4,571,140 A * 2/1986 Yamada et al. ..... 414/412
4,955,479 A 9/1990 Beer et al.
5,055,869 A 10/1991 DiPietro
5,137,269 A 8/1992 Yamamoto
5,473,400 A * 12/1995 Lemberger et al. ..... 396/513
5,477,310 A 12/1995 Lamb, Jr. et al.
6,376,057 B1 * 4/2002 Akao et al. ..... 428/215
6,720,126 B2 * 4/2004 Shimomura et al. ..... 430/200
2002/0127355 A1 * 9/2002 Miyake et al. ..... 428/34.1
2002/0157352 A1 10/2002 Tachikawa et al.

FOREIGN PATENT DOCUMENTS

JP 2004-170759 A 6/2004
JP 2004170759 A * 6/2004

* cited by examiner

*Primary Examiner*—Cynthia Kelly
*Assistant Examiner*—Connie Johnson
(74) *Attorney, Agent, or Firm*—Lucas & Mercanti, LLP

(57) ABSTRACT

Several sheets of sheet-shaped photosensitive material 1 are stacked on a paper tray container 2 prepared by press-forming stencil paper sheet, the photosensitive material 1 stacked on said paper tray container is inserted into a moisture-proof and light-shielding bag 3 made of a photosensitive material packaging material having moisture-proof and light-shielding properties and having an aluminum thin foil layer, and the moisture-proof and light-shielding bag 3 is sealed tight under a reduced pressure vacuum.

10 Claims, 5 Drawing Sheets

METHOD OF MANUFACTURE OF PHOTOSENSITIVE MATERIAL PACKAGING BODY AND PHOTOSENSITIVE MATERIAL PACKAGING BODY

This application is based on Japanese Patent Application No. 2004-2350077 filed on Aug. 12, 2004, in Japanese Patent Office, the entire content of which is hereby incorporated by reference.

TECHNICAL FIELD

The present invention relates to the method of manufacture of photosensitive material packaging bodies for packaging photosensitive materials such as X-ray films, etc., and to photosensitive material packaging bodies themselves. In particular, the present invention relates to the method of manufacture of photosensitive material packaging bodies for sealed packaging of tray containers in which are stacked sheet-shaped thermal development type photosensitive materials.

BACKGROUND

Conventionally, sheet-shaped photosensitive materials are stacked on a packaging material, and this stack of photosensitive materials is packaged tightly so as to seal them using the barrier packaging material. Sideways tilted U-shaped protective sheets (backing cardboard sheets) are used as the packaging material for protecting the sheet-shaped photosensitive material, as for example in the Japanese Utility Model Public Disclosure No. Sho 61-4915 and in the Japanese Utility Model Application Laid Open No. 55-164642. Further, examples of using plastic trays as packaging materials used for thermal development type photosensitive material are those given in Japanese Patent Application Laid Open No. 2002-31875, Japanese Patent Application Laid Open No. 2002-59980, and in Japanese Patent Application Laid Open No. 2002-72415. Also, addition of paper strength enhancing agent and sizing agents have been disclosed in Japanese Patent Application Laid Open No. Hei 7-104432 as the methods of preventing the generation of paper dust from the backing cardboard sheets used in the sheet-shaped photosensitive materials. Furthermore, Japanese Patent Application Laid Open No. Hei 11-258733 and Japanese Patent Application Laid Open No. Sho 60-26004 disclose methods of preventing the generation of paper dust from the backing cardboard sheets by bonding foam sheets or plastic films on the surface of the backing cardboard sheets. In addition, U.S. Pat. No. 5,473,400 and U.S. Pat. No. 5,480,134 disclose methods in which thermal development type photosensitive material is placed in a plastic tray on top of which is provided a film packaging material having a lid made of moisture-proofing sheet that can be re-sealed.

Patent Document 1: Japanese Utility Model Public Disclosure No. Sho 61-4915 (Page 1 to Page 2, FIG. 1)

Patent Document 2: Japanese Utility Model Application Laid Open No. 55-164642 (Page 1 to Page 5, FIG. 1)

Patent Document 3: Japanese Patent Application Laid Open No. 2002-31875 (Page 1 to Page 13, FIG. 1)

Patent Document 4: Japanese Patent Application Laid Open No. 2002-59980 (Page 1 to Page 16, FIG. 1 to FIG. 9)

Patent Document 5: Japanese Patent Application Laid Open No. 2002-72415 (Page 1 to Page 15, FIG. 1 to FIG. 7)

Patent Document 6: Japanese Patent Application Laid Open No. Hei 7-104432 (Page 1 to Page 8, FIG. 1 to FIG. 2)

Patent Document 7: Japanese Patent Application Laid Open No. Hei 11-258733 (Page 1 to Page 4, FIG. 1 to FIG. 2)

Patent Document 8: Japanese Patent Application Laid Open No. Sho 60-26004 (Page 1 to Page 5, FIG. 1)

Patent Document 9: U.S. Patent Public Disclosure No. 5473400

Patent Document 10: U.S. Patent Public Disclosure No. 5480134

Among such conventional technologies, the status of stacking products of photosensitive materials becomes stable when a plastic tray is used as the packaging material. However, plastic trays become too bulky at the time of their disposal after use, and even their environmental load is high in the burning stage during disposal. In addition, at the time of re-sealing, since the adhesive agent remains on the plastic tray and cannot be removed, value as a recyclable material becomes low.

In addition, when using paper backing cardboard, although the processing during disposal is easy compared to plastic trays, in particular, it is not possible to prevent the generation of paper dust due to the rubbing between flap side surface of the backing cardboard and the photosensitive material. There was the problem that even if larger quantities of sizing agents or paper strength enhancing agents are included in order to prevent the generation of paper dust, it only increases the cost and not much effect can be expected.

The present invention was made in view of the above aspects and the purpose of the present invention is to provide a method of manufacture of photosensitive material packaging body and photosensitive packaging body that prevent the generation of paper dust and also make the disposal processing easy after use.

SUMMARY

One aspect of the present invention is as described below.

A method of manufacturing a photosensitive material packaging body comprising the steps of:

forming paper tray container by press-forming stencil paper;

stacking sheet-shaped photosensitive materials in said paper tray container;

forming moisture-proof and light-shielding bag by forming photosensitive material packaging material having an aluminum film layer in the form of a bag;

storing said paper tray container in which are stacked said sheet-shaped photosensitive material in said moisture-proof and light-shielding bag; and sealing said moisture-proof and light-shielding bag storing said paper tray container in a state in which the pressure inside said bag is reduced.

BRIEF DESCRIPTION OF THE DRAWINGS

Embodiments will now be described, by way of example only, with reference to the accompanying drawings which are meant to be exemplary, not limiting, and wherein like elements numbered alike in several Figures, in which.

DESCRIPTION OF THE PREFERRED EMBODIMENT EFFECT OF THE INVENTION

According to the present invention, since the photosensitive material stacked on a paper tray container is stored in a moisture-proof and light-shielding bag, the moisture-proof and light-shielding bag is sealed tightly under a reduced pressure with respect to atmosphere, and the paper tray container is formed by press-forming paper, it is possible to prevent the generation of paper dust and also to make easy the disposal processing after use.

In addition, if the moisture content of the paper tray container is less than or equal to 3% by weight, the moisture content within the moisture-proof and light-shielding bag decreases, and hence it is possible to prevent the deterioration of the performance of the photosensitive material.

Furthermore, if the raising bent part from the bottom of the paper tray container to its side wall part is press-formed so that this raising bent part is compressed to 80% -90% of the thickness of the punched stencil paper, the raising shape of the side wall part is maintained by this pressing, and also the paper dust at the bottom part and at the side wall part enter inside the grains of the paper and hence it is possible to prevent the generation of paper dust.

Further, the moisture-proof and light-shielding bag is formed into the shape of a bag by heat sealing using a photosensitive material packaging material having a light-shielding and lubricating polyolefin resin type film layer, a nylon film layer provided as the outermost layer, and an aluminum foil layer provided in between the lubricant polyolefin resin type film layer and the nylon film layer, the moisture cannot permeate up to the paper tray container. Further, because the paper tray container does not have moisture content due to the moisture-proof and light-shielding bag, it is possible to prevent the deterioration in performance of the photosensitive material. Further, it is possible to prevent rubbing between the paper tray container and the moisture-proof and light-shielding bag thereby contributing to the prevention of generation of paper dust.

Further, since the surface resistivity of the paper tray container is less than or equal to $1\times10^{12}\Omega$, the amount of electrostatic charg is 10 secs or less, and hence it is possible to suppress the generation of static electricity as well as charging due to static electricity thus reducing the adhering of paper dust to the paper tray container.

Although, the method of manufacture of the photosensitive material packaging body and the photosensitive material packaging body according to a preferred embodiment of the present invention are described in the following, the present invention shall not be construed to be limited to this example. Further, the preferred embodiment of the present invention indicates a most desirable form of the invention, and the present invention shall not be restricted to this embodiment.

Figure 1:
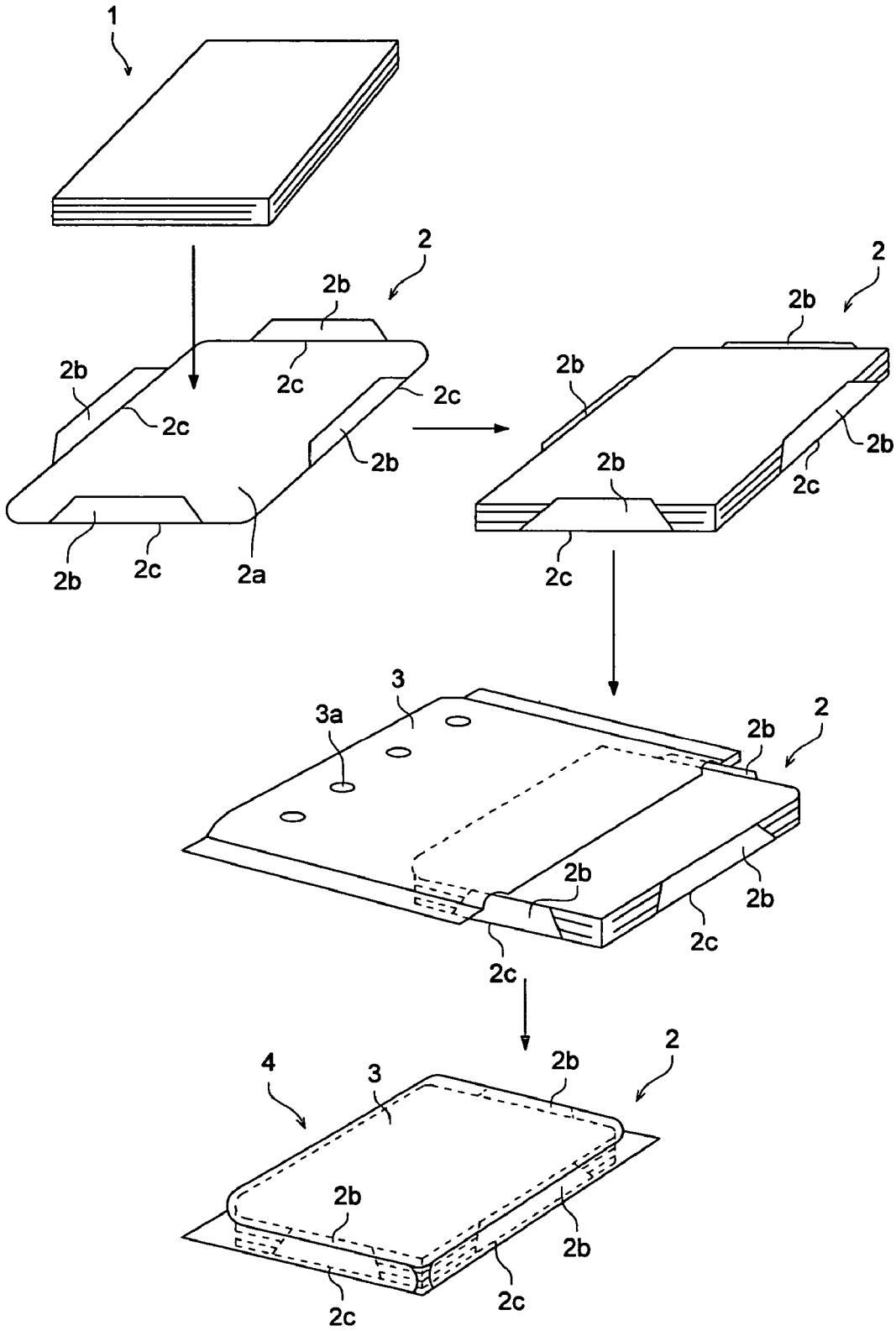
FIG. 1 is a diagram showing an example of the method of manufacturing photosensitive material packaging bodies.

FIG. 1 is a diagram showing an example of the method of manufacturing photosensitive material packaging bodies, wherein the numeral 1 denotes the stack of a plurality of sheet-shaped photosensitive materials, 2 is the paper tray container that protects the photosensitive material 1 having a plurality of sheet-shaped photosensitive materials. Further, although thermal development type photosensitive materials are used as the photosensitive material 1 having a plurality of sheet-shaped photosensitive materials in the present embodiment, the photosensitive material 1 need not be limited to thermal development type photosensitive materials. The photosensitive material 1 in the stacked state on the paper tray container 2 is stored in the moisture-proof and light-shielding bag 3, and the moisture-proof and light-shielding bag 3 is sealed tight under reduced pressure with respect to atmosphere thereby obtaining the photosensitive material packaging body 4.

Figure 2:
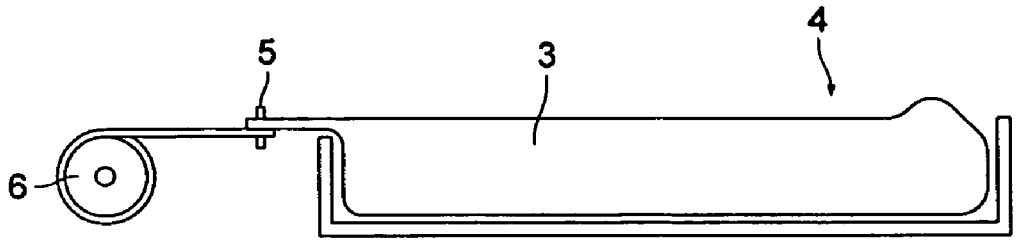
FIG. 2 is a diagram showing the state in which the photosensitive material is taken out and conveyed from the photosensitive material packaging body.
Figure 2:
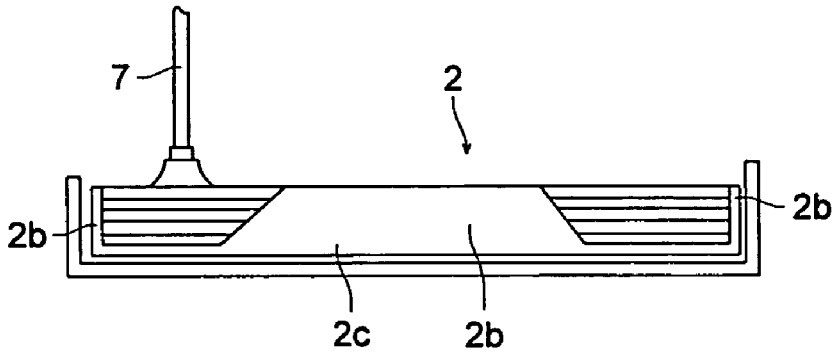
Figure 2:
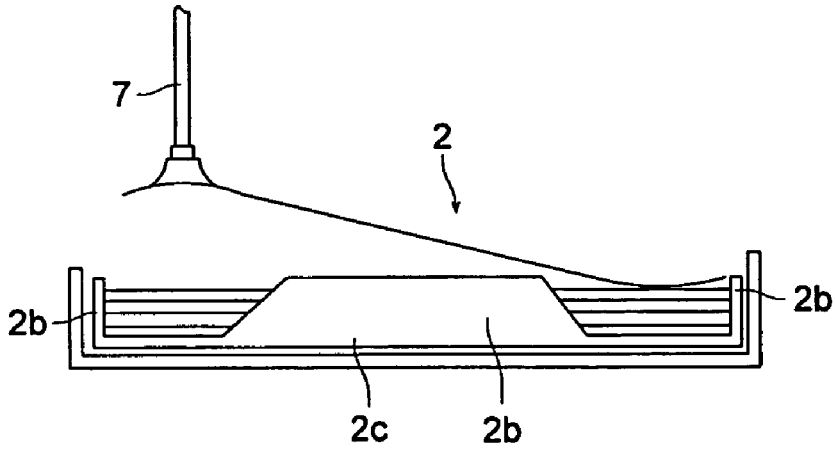
Figure 3:
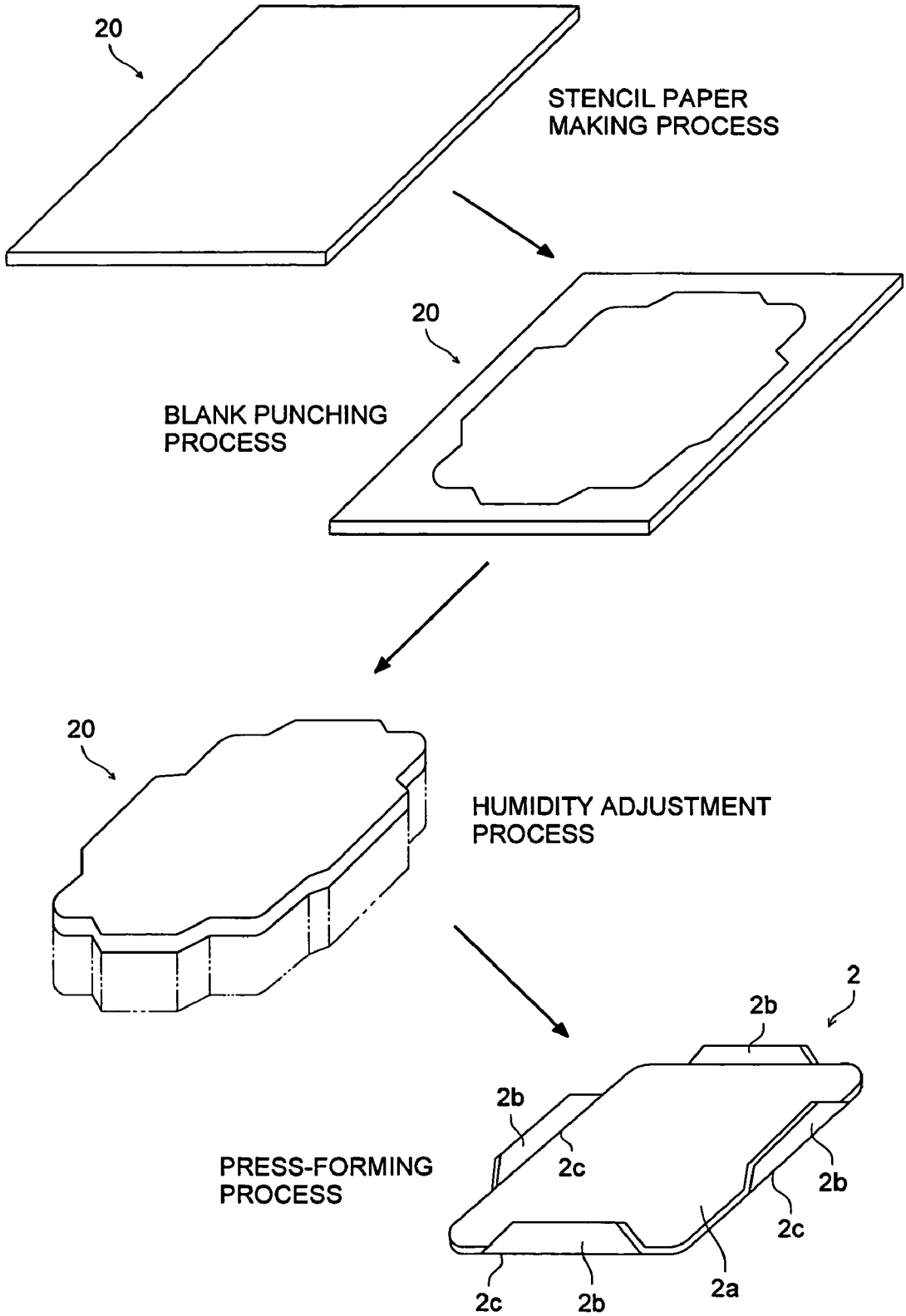
FIG. 3 is a diagram showing the process of forming the paper tray container.
Figure 4:
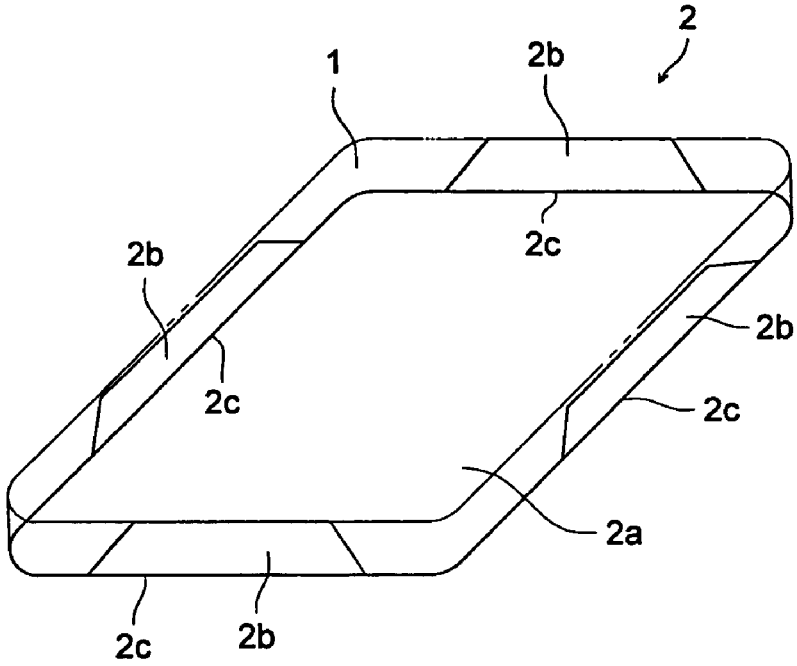
FIG. 4 is a perspective view diagram of the paper tray container.
Figure 5:
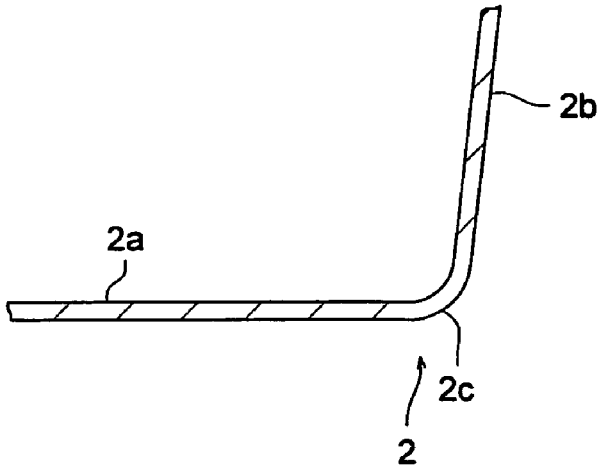
FIG. 5 is cross-sectional view diagram of the raising bent part from the bottom part to the side wall part of the paper tray container.

As is shown in FIG. 2, this photosensitive material packaging body 4 is inserted in the developing unit, the withdrawing member 5 is engaged with the latching hole 3*a* of the moisture-proof and light-shielding bag 3, and the moisture-proof and light-shielding bag 3 is removed by the rotation of the take up shaft 6 (FIG. 2(*a*)). Next, the photosensitive material 1 stored in the paper tray container 2 is sucked and lifted up by the suction cup 7 (FIG. 2(*b*)), and it is conveyed one sheet at a time (FIG. 2(*c*)). The paper tray container 2 in this embodiment has the bottom part 2*a* on which is placed the stacked photosensitive material 1, and four side wall parts 2*b* that rise up from the outer edges of this bottom part 2*a* and retain the stacked photosensitive material 1. This paper tray container 2 is manufactured as shown in FIG. 3 to FIG. 5. FIG. 3 is a diagram showing the process of forming the paper tray container, FIG. 4 is a perspective view diagram of the paper tray container, and FIG. 5 is cross-sectional view diagram of the raising bent part from the bottom part to the side wall part of the paper tray container.

As is shown in FIG. 3, the stencil paper 20 is prepared in the stencil paper making process. The moisture content of the stencil paper 20 is 8%-8.5% by weight. This stencil paper 20 is punched and cut in the punching process in the unfolded shape of the paper tray container 2. Next, in the moisture content adjustment process, several sheets of the stencil paper punched in the unfolded shape of the paper tray container 2 are stacked together and the moisture content is increased to about 10% by weight. Next, in the press-forming process, the stencil paper 20 in the unfolded shape of the paper tray container 2 is heated and press-formed thereby producing the paper tray container 2. The press-forming is carried out using press-forming molds, the temperature of the press-forming molds is 130-160° C., and the force of the press-forming molds is 15-250 kgf/cm$^2$. Here, the moisture content is the ratio of the difference between the weight of the sample in any state and the absolute dry weight of the sample to the absolute dry weight expressed as a percentage.

By heating and press-forming this stencil paper 20 in this unfolded shape, the moisture content of the paper tray container 2 becomes less than or equal to 3% by weight. By making the moisture content of the paper tray container less than or equal to 3% by weight, the moisture content in the moisture-proof and light-shielding bag 3 decreases, and hence it is possible to prevent deterioration in the performance of the photosensitive material 1.

As is shown in FIG. 4 and FIG. 5, the paper tray container 2 is formed by pressing so that the raising bent part 2*c* from the bottom part 2*a* to the side wall part 2*b* is compressed to 80%-90% of the thickness of the punched stencil paper. For example, if the thickness of the stencil paper is 0.6 mm, the press-forming is done so that the thickness of the raising bent part 2*c* is 0.4 to 0.45 mm, and because of this press-forming the raising shape of the side wall part 2*b* is maintained, and also the paper dust in the bottom part 2*a* and the side wall part 2*b* enter into the paper grains, and hence it is possible to prevent the generation of paper dust.

Further, the paper tray container 2 has its surface resistivity reduced to less than or equal to $1\times10^{12}\Omega$, and the half-life of an attenuation of charge is reduced to 10 secs or less by including antistatic material in the stencil paper or by coating it with antistatic material. In this manner, because the surface resistivity is less than or equal to $1\times10^{12}\Omega$ and the half-life of charge is 10 secs or less, it is possible to suppress the photosensitive material packaging body 4 from getting charged due to the generation of static electricity during its handling, and consequently to reduce the adhesion of paper dust to the paper tray container 2.

In this manner, since the photosensitive material 1 stacked on a paper tray container 2 is stored in a moisture-proof and light-shielding bag 3, the moisture-proof and light-shielding bag 3 is sealed tight under a reduced pressure with respect to atmosphere, and the paper tray container 2 is formed by press-forming paper, it is possible to prevent the generation of paper dust and also to make easy the disposal processing after use.

Figure 6:
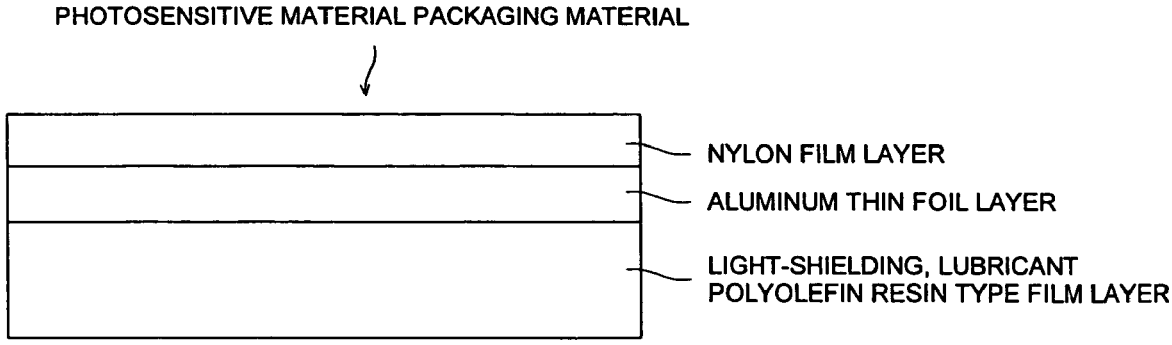
FIG. 6 is a diagram showing the layered structure of the photosensitive material packaging body.

In addition, as is shown in FIG. 6, the moisture-proof and light-shielding bag 3 is formed into the shape of a bag by heat sealing using a photosensitive material packaging material having a light-shielding and lubricating polyolefin resin type film layer having as its main constituents an ethylene-α-olefin copolymer resin having a light-shielding material, a lubricant material, an anti-oxidant material, and an antistatic material provided on the innermost layer that wraps the photosensitive materials, a nylon film layer provided as the outermost layer on the side not wrapping the photosensitive material, and an aluminum foil layer provided in between said light-shielding and lubricating polyolefin resin type film layer and said nylon film layer. In this manner, the moisture-proof and light-shielding bag 3 is formed in the shape of a bag 3 by heat sealing and the moisture cannot permeate up to the paper tray container 2. In addition, because the paper tray container 2 does not have moisture content due to the moisture-proof and light-shielding bag 3, it is possible to prevent the deterioration in performance of the photosensitive material 1. Further, it is possible to prevent rubbing between the paper tray container 2 and the moisture-proof and light-shielding bag 3 during manufacturing and delivering to a customer, thereby contributing to the prevention of generation of paper dust.

The tray container 2 in the present embodiment is formed out of paper and it is sufficient that it is made of paper. However, the cardboard used can be old paper such as coated cardboard or Manila cardboard, and also a cardboard made of recycled paper coated on both sides with virgin pulp or any corrugated paper cardboard stencil paper that is bonded by flute and liner can also be used.

In the following, explanation is given for thermal development type photosensitive-material as the photosensitive material to which the present invention can be applied. The thermal development type photosensitive material of the present invention is formed on a supporting body by solvent coating it with a photograph-constituting layer having organic silver chlorides, photosensitive silver halide, and silver ion reducing agent, and it is desirable to provide on top of that photograph-constituting layer, at least one protective layer. Further, it is desirable to have a so called single sided photosensitive material that has a backing layer on the other side of the supporting body when the photosensitive materials are stacked in the condition of the photograph-constituting layer facing to the bottom of tray.

Further, it is desirable that the photograph-constituting layer of the thermal development type photosensitive material comprises a photosensitive layer and a non-photosensitive layer, with the photosensitive layer having particles of organic silver salts and photosensitive silver halides, and the non-photosensitive layer having reducing agents.

Photosensitive Silver Halides:

Silver halide particles function as light sensors. In the present invention, in order to suppress milky whiteness after image forming and in order to obtain good image quality, it is desirable that the average particle diameter is small, desirably less than 0.20 μm, more desirably more than 0.02 μm but less than 0.15 μm, and still more desirably more than 0.03 μm but less than 0.11 μm.

The average particle diameter mentioned here is the length of an edge of the silver halide particle, when the silver halide particle is a cubic or an octahedral regular crystal. Further, when it is not a regular crystal, for example, when it is a spherical, a cylindrical, or a flat-plate shaped particle, this is the diameter of a sphere having the same volume as that of the silver halide particle.

Further, it is desirable that the silver halide particle is a monodispersible particle. Here, a monodispersible particle is a particle having a monodispersibility of 40% or less, more desirably 30% or less, still more desirably 20% or less.

Monodispersibility=(Standard deviation of particle diameter)/(average value of particle diameter)×100

Although there is no restriction on the shape of the silver halide particles, it is desirable that the percentage of the mirror index surface [100] is high, and this ratio should be 50% or more, more desirably 70% or more, still more desirably 80% or more. The ratio of the Miller's index [100] surface can be obtained according to T. Tani, J. Imaging Sci., 29, 165 (1985) using the adsorption dependency of the [111] surface and the [100] surface in sensitizer adsorption.

Although there is no special restriction on the halogen composition, they can be any among—silver chloride, silver bromide-chloride, silver bromide-chloride-iodide, silver bromide, silver bromide-iodide, and silver iodide, and desirably be silver bromide, or silver iodide, or silver bromide-iodide, and still more desirably be silver bromide or silver bromide-iodide. Particularly desirable is silver bromide iodide, and the content of silver iodide should desirably be 0.1 mol % or more but less than 40 mol %, still more desirably be 0.1 mol % or more or 10 mol % or less. The distribution of halogen composition within the particles can be uniform or can be one in which the halogen composition changes in a stepwise manner, or it can be a particle with continuously changing halogen composition. In particular, it is desirable to use a silver halide particle with a core/shell structure having a high silver iodide content ratio within the particle.

Organic Silver Salts:

The organic silver Salts that can be used in the present invention are silver Salts that are relatively stable with respect to light and form silver images when heated to 80° C. or more in the presence of exposed optical catalyst (photographic silver halide) and reducing agents.

Organic silver Salts can also be any organic material including a source that can reduce silver ions. It is desirable to use silver chlorides of organic acids, and particularly desirable to use long chain aliphatic carboxylic acids (a carbon number of 10-30 is desirable, and a carbon number in the range of 15-28 is more desirable).

It is desirable to use an organic or inorganic silver Salt having a total stability constant with the ligand being in the range of 4.0-10.0. The silver source material should desirably constitute about 5-30% by weight of the photosensitive layer. The desirable organic silver salts include silver salts of organic compounds having a carboxyl radical. Although these examples include silver salts of aliphatic carboxylic acids and silver salts of aromatic carboxylic acids, it is not necessary to limit only to these. Some desirable examples of silver salts of aliphatic carboxylic acids are—silver behenate, silver stearate, silver arachidate, silver oleate, silver laurate, silver caproate, silver myristate, silver palmitate, silver maleate, silver fumarate, silver tartrate, silver linoleate, silver butyrate, and silver camphorate, and their mixtures are also included. It is also possible to use silver salts of compounds containing mercaptol and thion radicals and their derivatives.

Reducing Agents of Silver Ions:

Reducing agents of silver ions are the reducing agents for organic silver salts, and the reducing agents that can be used in the present invention can be any reducing agent that reduces silver ions into metallic silver, and can desirably be an organic material. Although conventional photographic developers such as phenidone, hydroquinone, and catechol are usable, hindered phenol reducing agent is desirable.

It is desirable that the reducing agent is present to an extent in the range of about 1-10% by weight of the photograph-constituting layer (the image forming layer). When the photosensitive material has a multi-layered structure, and when the reducing agent is added in a layer other than the emulsion layer, there is a trend that it is desirable to have a slightly higher ratio of about 2-15% by weight.

Binder:

The binder ideally suited for the thermal development type photosensitive material according to the present invention is either transparent or translucent, generally colorless, and is a medium forming natural polymer synthetic plastic, or polymer and copolymer, or other films, such as for example, gelatin, Arabia rubber, poly(vinyl alcohol), hydroxy-ethyl cellulose, cellulose acetate, cellulose acetate butylate, poly(vinyl pyrrolidone), casein, starch, poly(acrylate), poly(methylmethacrylate), poly(vinyl chloride), poly (methacrylate), copoly(styrene-maleic anhydride), copoly (styrene-acrylonitrile), copoly(styrene-butadiene), poly (vinyl acetal) types (for example, poly(vinyl formal) and poly(vinyl butyral)), poly(ester) types, poly(urethane) types, phenoxy plastics, poly(vinylidene chloride), poly(epoxide) types, poly(carbonate) types, poly(vinyl acetate), cellulose ester types, and poly(amide) types. Both hydrophilic and non-hydrophilic materials can be used.

Other Additives:

In the present invention, it is desirable to include matting agents in the photosensitive layer, in order to prevent scratching of the image after thermal development, it is desirable to distribute matting agent on the surface of the photosensitive layer, and it is desirable that this matting agent is included to the extent of about 0.5-10% by weight of the total binder on the emulsion layer side.

The material of the matting agent used in the present invention can either be an organic material or an inorganic material. For example, as an inorganic material it is possible to use silica as disclosed in Swiss patent No. 330,158, etc., glass powder as disclosed in French patent No. 1,296,995, etc., carbonates of alkali earth metals or cadmium, zinc, etc., as disclosed in British patent No. 1,173,181, etc.

As an organic material, it is possible to use starch as disclosed in U.S. Pat. No. 2,322,037, etc., starch derivatives as disclosed in Belgian patent No. 625,451 and British patent No. 981,198, etc., polyvinyl alcohol as disclosed in Japanese Patent Disclosure No. Sho 44-3643, etc., polystyrene or poly-methacrylate as disclosed in Swiss patent No. 330,158, etc., poly-acrylonitrile as disclosed in U.S. Pat. No. 3,079,257, etc., or polycarbonate as disclosed in U.S. Pat. No. 3,022,169, etc.

The shape of the matting agent can be both regular and irregular, while it is desirable that the shape is regular, spherical shape is used preferably.

EXAMPLES

A paper tray container, having a bottom part on which is placed a stack of photosensitive materials, and a side wall part which raises from at least one part of the edges of this bottom part and which protects the stacked photosensitive materials, was formed by pressing so that the raising bent part from the bottom part to the side wall part was compressed to about 80%-90% of the thickness of the stencil sheet. When the raising bent part from the bottom part to the side wall part of the paper tray container was formed by pressing so that it is compressed to 80%-90% of the thickness of the stencil sheet, the rising shape of the side wall was maintained because of pressing, and also, the paper dust in the bottom part and in the side wall part got into the grains of the paper and hence it was possible to prevent the generation of paper dust.

This result is shown in Tables 1 to 4. In the comparison example of Table 1, the compression ratio is small, and the compression ratio is large in the comparison example of Table 4, and point defects occurred in the film. When the compression was made to 80%-90% of the thickness of the stencil sheet in the embodiments shown in Table 2 and Table 3, no point defects occurred in the film.

Further, if the surface resistivity of the paper tray container is less than or equal to $1\times10^{12}\Omega$, and the half-life of charge is 10 secs or less, the generation of static electricity and consequent charging are suppressed which is desirable because it was possible to reduce the adhesion of paper dust to the paper tray container.

Method of Evaluating Film Defects:

Film: 127-sheet Konica dry imaging films were used.

Development Process: The development was done using the dry imager Drypro 722 and the development temperature was 126° C.

Defect Evaluation: In the rush printed film to half frames, white spots of size 0.5 mm or more were counted, and the film was judged to be defective if there was even one spot.

[Tray Moisture Content]

The measurement was made using a method conforming to JIS-P8127.

TABLE 1

| No. | Tray moisture content (%) | Compression ratio (%) | Number of film defects | Surface resistivity value (Ω) |
|---|---|---|---|---|
| 1 | 0 | 65 | 32 | 5.00E + 14 |
| 2 | 1 | 65 | 20 | 3.50E + 13 |
| 3 | 2 | 65 | 5 | 1.00E + 12 |
| 4 | 3 | 65 | 3 | 2.00E + 12 |
| 5 | 4 | 65 | 2 | 4.00E + 12 |
| 6 | 5 | 65 | 2 | 8.00E + 12 |
| 7 | 6 | 65 | 22 | 2.00E + 13 |

TABLE 1-continued

| No. | Tray moisture content (%) | Compression ratio (%) | Number of film defects | Surface resistivity value (Ω) |
|---|---|---|---|---|
| 8 | 8 | 65 | 48 | 3.00E + 14 |
| 9 | 10 | 65 | 73 | 8.00E + 13 |

TABLE 2

| No. | Tray moisture content (%) | Compression ratio (%) | Number of film defects | Surface resistivity value (Ω) |
|---|---|---|---|---|
| 1 | 0 | 80 | 0 | 6.00E + 12 |
| 2 | 1 | 80 | 0 | 7.00E + 12 |
| 3 | 2 | 80 | 0 | 3.00E + 12 |
| 4 | 3 | 80 | 0 | 4.00E + 12 |
| 5 | 4 | 80 | 0 | 6.00E + 12 |
| 6 | 5 | 80 | 0 | 3.00E + 12 |
| 7 | 6 | 80 | 0 | 8.00E + 12 |
| 8 | 8 | 80 | 0 | 9.00E + 12 |
| 9 | 10 | 80 | 0 | 6.00E + 12 |

TABLE 3

| No. | Tray moisture content (%) | Compression ratio (%) | Number of film defects | Surface resistivity value (Ω) |
|---|---|---|---|---|
| 1 | 0 | 90 | 0 | 9.00E + 12 |
| 2 | 1 | 90 | 0 | 7.00E + 12 |
| 3 | 2 | 90 | 0 | 3.00E + 12 |
| 4 | 3 | 90 | 0 | 5.00E + 12 |
| 5 | 4 | 90 | 0 | 6.00E + 12 |
| 6 | 5 | 90 | 0 | 7.00E + 12 |
| 7 | 6 | 90 | 0 | 8.00E + 12 |
| 8 | 8 | 90 | 0 | 2.00E + 12 |
| 9 | 10 | 90 | 0 | 4.00E + 12 |

TABLE 4

| No. | Tray moisture content (%) | Compression ratio (%) | Number of film defects | Surface resistivity value (Ω) |
|---|---|---|---|---|
| 1 | 0 | 95 | 22 | 9.00E + 12 |
| 2 | 1 | 95 | 12 | 8.00E + 13 |
| 3 | 2 | 95 | 3 | 7.00E + 14 |
| 4 | 3 | 95 | 4 | 5.00E + 13 |
| 5 | 4 | 95 | 9 | 3.00E + 13 |
| 6 | 5 | 95 | 15 | 4.00E + 13 |
| 7 | 6 | 95 | 41 | 4.00E + 14 |
| 8 | 8 | 95 | 67 | 6.00E + 13 |
| 9 | 10 | 95 | 88 | 8.00E + 13 |

In this manner, several sheets of the photosensitive material are stacked on a paper tray container, and this stack of photosensitive material stacked on a paper tray is inserted in a moisture-proof and light-shielding bag which is formed using a photosensitive material packaging material having moisture-proof and light-shielding property and having an aluminum thin foil layer, and this moisture-proof and light-shielding bag is sealed tight under a reduced pressure vacuum. The paper tray container is formed by press-forming paper, and it is possible to prevent the generation of paper dust and also to make easy the disposal processing after use.

What is claimed is:

1. A method of manufacturing a photosensitive material packaging body, comprising the steps of:

forming paper tray container by press-forming stencil paper;

stacking sheet-shaped photosensitive materials in said paper tray container;

forming moisture-proof and light-shielding bag by forming photosensitive material packaging material having an aluminum film layer in the form of a bag;

storing said paper tray container on which said sheet-shaped photosensitive materials are stacked in said moisture-proof and light-shielding bag; and sealing said moisture-proof and light-shielding bag storing said paper tray container in a state in which the pressure inside said bag is reduced.

2. The method of manufacturing the photosensitive material packaging body of claim 1, wherein the moisture content of said paper tray container is 3% by weight or less.

3. The method of manufacturing the photosensitive material packaging body of claim 1, wherein said paper tray container comprises a bottom part on which said sheet-shaped photosensitive materials are stacked; and a side wall part which is a part of said bottom part, is formed almost perpendicular to said bottom part, and retains the stack of said sheet-shaped photosensitive materials, wherein the raising bent part from said bottom part to said side wall part is formed by a press until the raising bent part is compressed to 80% to 90% of the thickness of said stencil paper.

4. The method of manufacturing the photosensitive material packaging body of claim 1, wherein said photosensitive material packaging material comprises in the following order of:

a light-shielding and lubricating polyolefin resin type film layer having a light-shielding material, a lubricant, an antioxidant, an antistatic additive, and having an ethylene-α-olefin co-polymer resin as main constituents, said aluminum thin foil layer, and a nylon film layer.

5. The method of manufacturing the photosensitive material packaging body of claim 1, wherein the surface resistivity of said paper tray container is less than or equal to $1\times10^{12}\Omega$, and a half-life of charge is 10 sec. or less.

6. A photosensitive material packaging body, comprising:

stack of sheet-shaped photosensitive materials;

a paper tray container of press-formed stencil paper for stacking said stack of sheet-shaped photosensitive materials, said container having a bottom part on which said stack said sheet-shaped photosensitive materials are stacked, and a side wall part, being a flat plate which is a part of said bottom part, which is formed almost perpendicular to said bottom part, and which retains the stack of said sheet-shaped photosensitive materials; and a moisture-proof and light-shielding bag formed using a photosensitive material packaging material having an aluminum film layer in which is stored said paper tray container on which said stack of sheet-shaped photosensitive materials are stacked, wherein said moisture-proof and light-shielding bag is sealed in a state in which the pressure inside said bag is reduced.

7. The photosensitive material packaging body of claim 6, wherein the moisture content of said paper tray container is 3% by weight.

8. The photosensitive material packaging body of claim 6, wherein the thickness of the rising bent part comprising said bottom part and said side wall part is 80%-90% to the thickness of said bottom part.

9. The photosensitive material packaging body of claim 6, wherein said photosensitive material packaging material comprises in the following order of:

a light-shielding and lubricating polyolefin resin type film layer having a light-shielding material, a lubricant, an antioxidant, an antistatic additive, and having an ethylene-α-olefin co-polymer resin as main constituents, said aluminum thin foil layer, and a nylon film layer.

10. The photosensitive material packaging body of claim 6, wherein the surface resistivity of said paper tray container is less than or equal to $1\times100^{12}\Omega$, and a half-life of charge is 10 sec. or less.

* * * * *